US005711421A

United States Patent [19]

Guo

[11] Patent Number: 5,711,421

[45] Date of Patent: Jan. 27, 1998

[54] SPRAY GUN ASSEMBLY

[76] Inventor: Wen Li Guo, No. 10, Fang Dong Road, Wen Gin Tsuen, Fang Yuan Hsiang, Chang Hua Hsien, Taiwan

[21] Appl. No.: 713,011

[22] Filed: Sep. 12, 1996

[51] Int. Cl.[6] ..... B65D 75/00

[52] U.S. Cl. ..... 206/223; 206/349; 206/486; 206/775

[58] Field of Search ..... 206/349, 341, 206/343, 345, 346, 347, 223, 216, 486, 490, 775

[56] References Cited

U.S. PATENT DOCUMENTS 3,674,138 7/1972 Gilmour ..... 206/349

3,870,144 3/1975 Hanson ..... 206/349 X 4,851,964 7/1989 Endo ..... 206/345 X 5,511,661 4/1996 Karlis et al. ..... 206/345 X

*Primary Examiner*—Jacob K. Ackun

*Attorney, Agent, or Firm*—Charles E. Baxley, Esq.

[57] ABSTRACT

A spray gun includes a panel having a number of openings for engaging with a number of elements which are coupled to the panel by a number of studs. The elements may be disengaged from the panel by braking the studs for allowing the elements to be assembled into the spray gun. The elements are secured to the panel for allowing the elements and the panel to be easily displayed. The elements may be easily seen by the user and may be easily assembled together by the users themselves.

4 Claims, 3 Drawing Sheets

SPRAY GUN ASSEMBLY

BACKGROUND OF THE INVENTION

1. Field of the Invention

The present invention relates to a spray gun, and more particularly to a spray gun assembly.

2. Description of the Prior Art

Typical spray guns comprise an integral structure that may not be assembled by the users themselves.

The present invention has arisen to mitigate and/or obviate the afore-described disadvantages of the conventional spray guns.

SUMMARY OF THE INVENTION

The primary objective of the present invention is to provide a spray gun assembly which may be easily assembled by the users themselves.

The other objective of the present invention is to provide a spray gun assembly which includes a number of parts or elements engaged in a panel for allowing the parts to be easily seen and to be easily disengaged from the panel for assembling purposes.

In accordance with one aspect of the invention, there is provided a spray gun assembly comprising a panel including a plurality of openings formed therein, a plurality of elements engaged in the openings respectively, and means for coupling the elements to the panel for allowing the elements and the panel to be displayed. The elements are disengaged from the panel by braking the coupling means for allowing the elements to be assembled into the spray gun assembly.

The elements include a gun body engaged in a first of the openings and coupled to the panel by at least one first stud, the gun body includes an upper and front portion and includes a rear and middle portion and includes a bottom portion, the elements include a valve stem for engaging in the gun body, the valve stem includes a rear end extended rearward beyond the gun body, the elements include a cap for engaging with the upper and front portion of the gun body, a knob for engaging with the rear end of the valve stem, a coupler for engaging with the bottom portion of the gun body, and a handle having a middle portion pivotally coupled to the rear and middle portion of the gun body at a pivot shaft, the handle includes an upper portion having an orifice formed therein for engaging with the rear end of the valve stem.

The panel includes a plane area for providing manual thereon. The panel further includes an arm extended therefrom for supporting at least one spring and at least one sealing ring thereon. The panel includes an upper portion having a hand grip provided thereon for hanging and carrying purposes.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
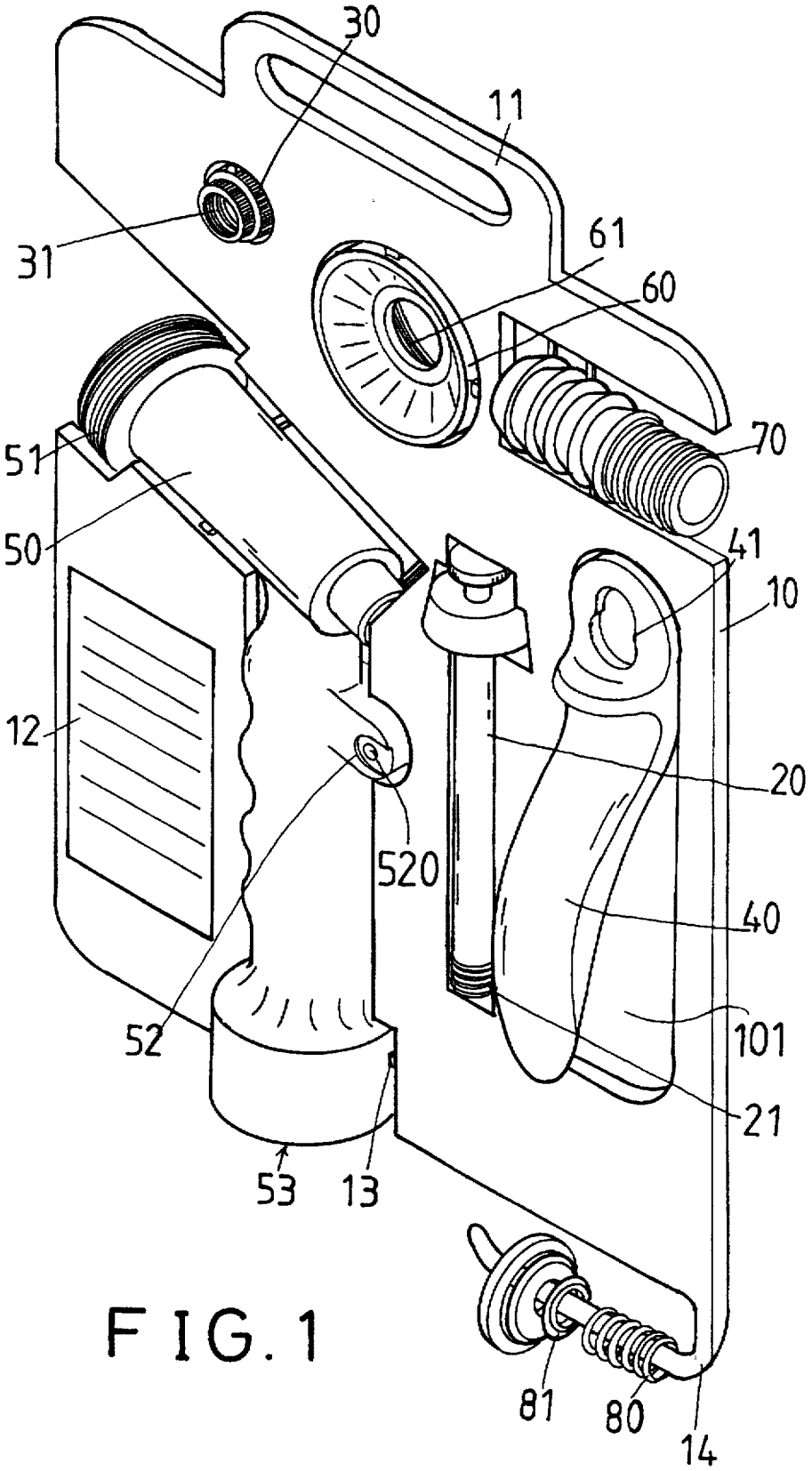
FIG. 1 is a perspective view of a spray gun assembly in accordance with the present invention, showing the elements before assembled.
Figure 2:
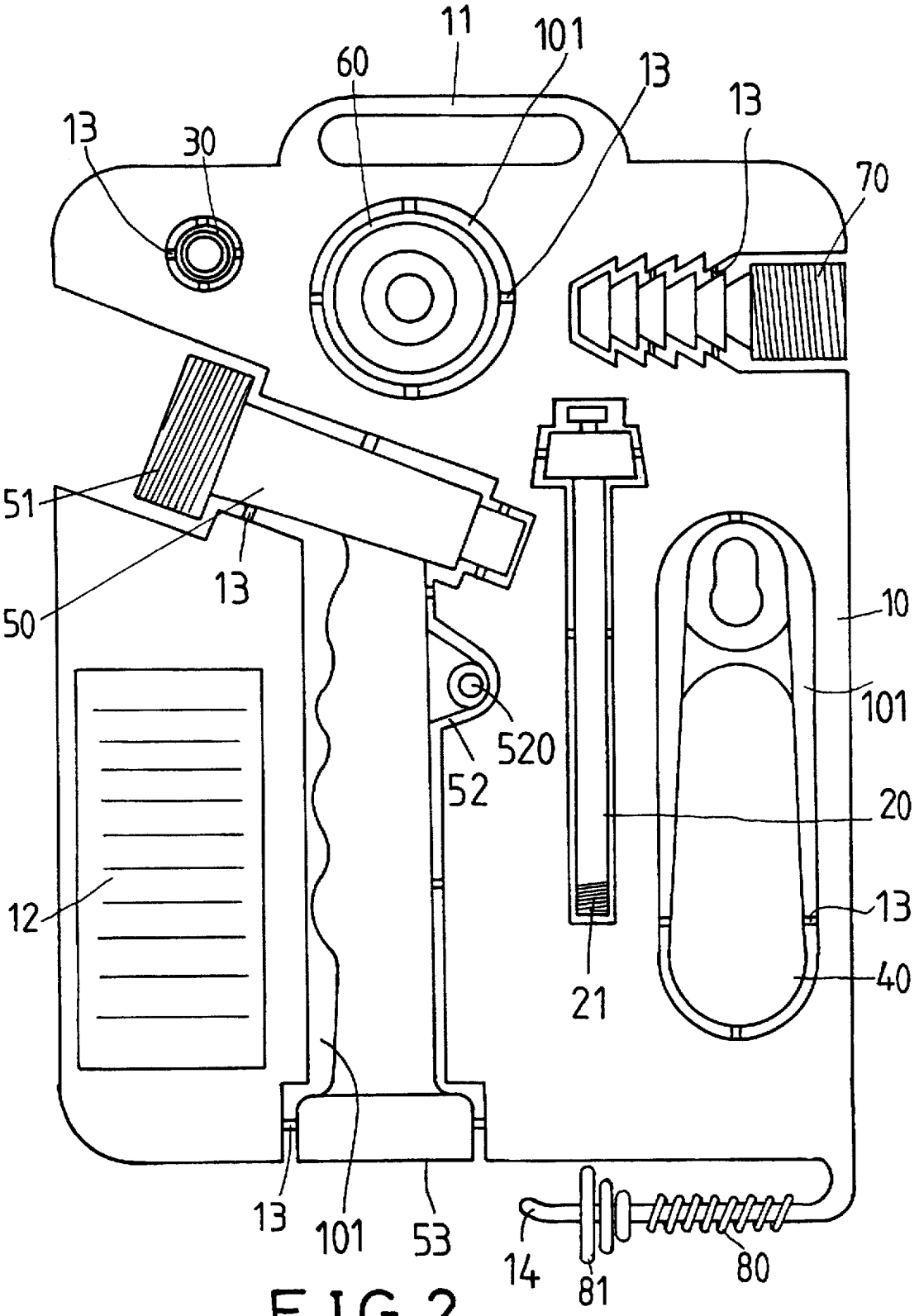
FIG. 2 is a plane view of the spray gun assembly as shown in FIG. 1.

Referring to the drawings, and initially to FIGS. 1 and 2, a spray gun assembly in accordance with the present invention comprises a panel 10 including a hand grip 11 provided on top for hanging and carrying purposes, and including a plane area 12 for printing manual or specification of the spray gun assembly. The panel 10 includes a number of openings 101 formed therein for engaging with a number of elements of the spray gun assembly which includes a valve stem 20, a knob 30, a handle 40, a gun body 50, a cap 60, a coupler 70. The elements 20, 30, 40, 50, 60, 70 are engaged in the openings 101 and are secured to the panel 10 by a number of studs 13. The panel 10 includes an arm 14 for supporting a spring 80 and a number of sealing rings 81. The elements 20, 30, 40, 50, 60, 70 and the studs 13 and the arm 14 are formed integral by molding process.

Figure 3:
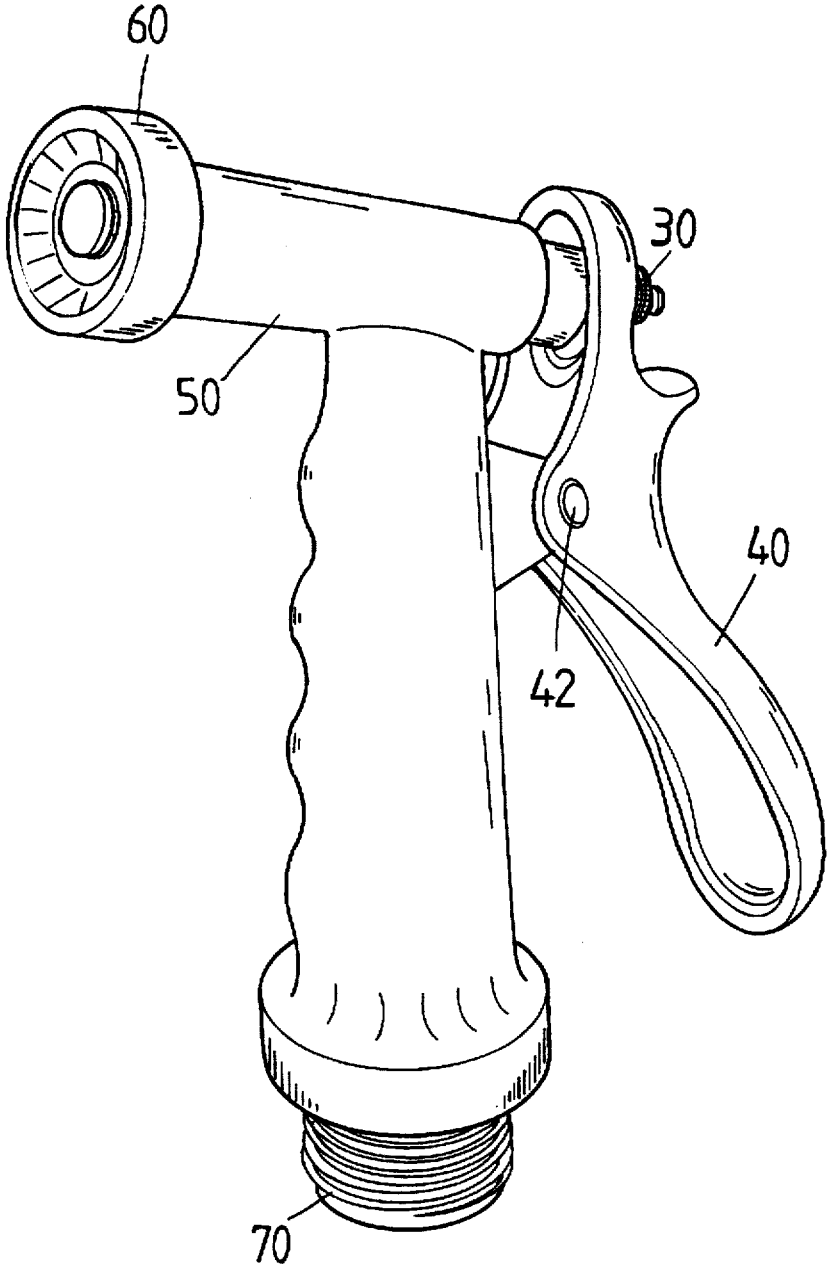
FIG. 3 is a perspective view of the spray gun assembly after assembled.

Referring next to FIG. 3 and again to FIGS. 1 and 2, the elements 20–70 may be disengaged from the panel 10 by braking the studs 13 and may be easily assembled to form the spray gun assembly. The gun body 50 includes an upper and front portion having an outer thread 51 formed thereon for threadedly engaging with an inner thread 61 of the cap 60. The valve stem 20 is engaged into the gun body 50 before the cap 60 is secured to the gun body 50. The spring 80 and the sealing rings 81 are provided for being engaged onto the valve stem 20. The valve stem 20 includes a rear end extended rearward beyond the gun body 50 and includes an outer thread 21 for engaging with the inner thread 31 of the knob 30. The rear end of the valve stem 20 is engaged through an orifice 41 of the handle 40 before the knob 30 is engaged with the valve stem 20. The gun body 53 includes a bottom aperture 53 for engaging with the coupler 70 which is provided for coupling to a water reservoir. The gun body 50 includes an ear 52 formed on the middle and rear portion and having a hole 520 formed therein. The handle 40 includes a middle portion pivotally coupled to the ear 52 by a pivot shaft 42 or includes two pivot pins provided in the middle portion for engaging with the hole 520 of the ear 52 and for allowing the handle 40 to be pivotally coupled to the gun body 50.

In assembling, the elements may be disengaged from the panel 10 by braking the studs 13 and may be easily assembled to form the spray gun assembly by following the manual provided on the plane area 12 of the panel 10. It is to be noted that the elements and the panel may be easily hung on supporting rod for displaying purposes.

Accordingly, the spray gun assembly in accordance with the present invention includes a number of elements that may be easily assembled by the users themselves. The elements are engaged in the panel for allowing the elements to be easily seen and to be easily disengaged from the panel for assembling purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A spray gun assembly comprising:

a panel including a plurality of openings formed therein, a plurality of elements engaged in said openings respectively, said elements including a gun body engaged in a first of said openings and coupled to said panel by at least one first stud, said gun body including an upper and front portion and including a rear and middle portion and including a bottom portion, said elements including a valve stem for engaging in said gun body, said valve stem including a rear end extended rearward beyond said gun body, said elements including a cap for engaging with said upper and front portion of said gun body, a knob for engaging with said rear end of said valve stem, a coupler for engaging with said bottom portion of said gun body, and a handle having a middle portion pivotally coupled to said rear and middle portion of said gun body at a pivot shaft, said handle including an upper portion having an orifice formed therein for engaging with said rear end of said valve stem, and means for coupling said elements to said panel for allowing said elements and said panel to be displayed, said elements being disengaged from said panel by braking said coupling means for allowing said elements to be assembled into said spray gun assembly.

2. A spray gun assembly according to claim 1, wherein said panel includes a plane area for providing manual thereon.

3. A spray gun assembly according to claim 1, wherein said panel further includes an arm extended therefrom for supporting at least one spring and at least one sealing ring thereon.

4. A spray gun assembly according to claim 1, wherein said panel includes an upper portion having a hand grip provided thereon for hanging and carrying purposes.

* * * * *